US011784398B2

(12) United States Patent
Kawamura et al.

(10) Patent No.: US 11,784,398 B2
(45) Date of Patent: Oct. 10, 2023

(54) ANTENNA DEVICE AND EARPHONES

(71) Applicants: SONY SEMICONDUCTOR SOLUTIONS CORPORATION, Kanagawa (JP); SONY CORPORATION, Tokyo (JP)

(72) Inventors: Takashi Kawamura, Kanagawa (JP); Masahiro Sato, Tokyo (JP)

(73) Assignees: SONY SEMICONDUCTOR SOLUTIONS CORPORATION, Kanagawa (JP); SONY CORPORATION, Tokyo (JP)

( * ) Notice: Subject to any disclaimer, the term of this patent is extended or adjusted under 35 U.S.C. 154(b) by 279 days.

(21) Appl. No.: 17/283,538

(22) PCT Filed: Jul. 25, 2019

(86) PCT No.: PCT/JP2019/029159
§ 371 (c)(1),
(2) Date: Apr. 7, 2021

(87) PCT Pub. No.: WO2020/079911
PCT Pub. Date: Apr. 23, 2020

(65) Prior Publication Data

US 2021/0391644 A1 Dec. 16, 2021

(30) Foreign Application Priority Data

Oct. 15, 2018 (JP) ..... 2018-194238

(51) Int. Cl.
*H01Q 1/36* (2006.01)
*H01Q 1/27* (2006.01)
(Continued)

(52) U.S. Cl.
CPC ..... *H01Q 1/36* (2013.01); *H01Q 1/273* (2013.01); *H01Q 1/48* (2013.01); *H04R 1/1016* (2013.01)

(58) Field of Classification Search
CPC . H01Q 1/36; H01Q 1/48; H01Q 11/08; H01Q 1/243; H01Q 1/27; H01Q 1/273; H04R 1/10
See application file for complete search history.

(56) References Cited

U.S. PATENT DOCUMENTS 11,237,526 B2 * 2/2022 Kita ..... G04R 60/10
2003/0169209 A1 * 9/2003 Ohara ..... H01Q 1/242 343/702

(Continued)

FOREIGN PATENT DOCUMENTS

CN 1441980 A 9/2003
CN 106331928 A 1/2017

(Continued)

OTHER PUBLICATIONS

International Search Report and Written Opinion of PCT Application No. PCT/JP2019/029159, dated Sep. 24, 2019, 06 pages of ISRWO.

*Primary Examiner* — Hasan Islam
(74) *Attorney, Agent, or Firm* — CHIP LAW GROUP

(57) ABSTRACT

An antenna device includes: a first terminal to which a high-frequency signal is input; a second terminal connected to the ground; a first radiation unit that is formed in a helical shape whose maximum diameter is a first diameter; a second radiation unit that is formed in a helical shape having one end continuous with one end of the first radiation unit and whose maximum diameter is a second diameter larger than the first diameter, and having another end which is an open end; first wiring that connects another end of the first (Continued)

FIRST EMBODIMENT radiation unit and the first terminal; and second wiring that connects the another end of the first radiation unit and the second terminal.

16 Claims, 13 Drawing Sheets

(51) Int. Cl.
*H01Q 1/48* (2006.01)
*H04R 1/10* (2006.01)

(56) References Cited

U.S. PATENT DOCUMENTS

| | | | | |
|---|---|---|---|---|
| 2012/0274534 | A1 | 11/2012 | Pan | |
| 2013/0207856 | A1 | 8/2013 | Oon et al. | |
| 2017/0295420 | A1 | 10/2017 | Yeung | |
| 2020/0028246 | A1* | 1/2020 | Kim | H04R 25/60 |

FOREIGN PATENT DOCUMENTS

| | | | |
|---|---|---|---|
| CN | 107331953 | A | 11/2017 |
| CN | 207082628 | U | 3/2018 |
| CN | 107919527 | A | 4/2018 |
| JP | 2001-352212 | A | 12/2001 |
| JP | 2005-197864 | A | 7/2005 |
| JP | 2009225262 | A | 10/2009 |

* cited by examiner

FIRST EMBODIMENT

SECOND EMBODIMENT

THIRD EMBODIMENT

FOURTH EMBODIMENT

FIFTH EMBODIMENT

SIXTH EMBODIMENT

SEVENTH EMBODIMENT

RADIATION DIRECTIVITY OF ANTENNA ALONE

ANTENNA DEVICE AND EARPHONES

CROSS REFERENCE TO RELATED APPLICATIONS

This application is a U.S. National Phase of International Patent Application No PCT/JP2019/029159 filed on Jul. 25, 2019, which claims priority benefit of Japanese Patent Application No. JP 2018-194238 filed in the Japan Patent Office on Oct. 15, 2018. Each of the above-referenced applications is hereby incorporated herein by reference in its entirety.

TECHNICAL FIELD

The present technology relates to an antenna device and earphones including the antenna device.

BACKGROUND ART

In recent years, in a situation where various electronic devices are capable of wireless communication, various small antennas to be built into electronic devices have also been developed.

Patent Document 1 below discloses a technique for implementing a compact, high-performance antenna with easy impedance adjustment, which is an at least partially helical inverted-F antenna.

CITATION LIST

Patent Document

Patent Document 1: Japanese Patent Application Laid-Open No. 2001-352212

SUMMARY OF THE INVENTION

Problems to be Solved by the Invention

Incidentally, in recent years, in particular, downsizing of devices has progressed, and along with this, further downsizing of the built-in antenna has been required. For example, in a case of building into miniaturized wireless earphones, the antenna size becomes very small.

Additionally, the maximum performance of a small antenna is proportional to the cube of the antenna size. Conversely, if the size is reduced, antenna performance will be reduced significantly.

Hence, an objective of the present technology is to improve antenna performance by effectively utilizing the volume of an antenna.

Solutions to Problems

An antenna device according to the present technology includes: a first terminal; a second terminal; a first radiation unit that is formed in a helical shape whose maximum diameter is a first diameter; a second radiation unit that is formed in a helical shape having one end continuous with one end of the first radiation unit and whose maximum diameter is a second diameter larger than the first diameter, and having another end which is an open end; first wiring that connects another end of the first radiation unit and the first terminal; and second wiring that connects the another end of the first radiation unit and the second terminal.

The first radiation unit has a portion having a smaller diameter than the second radiation unit, and the difference in diameter creates a wiring space.

In the antenna device according to the present technology described above, the first terminal, the second terminal, the first radiation unit, the second radiation unit, the first wiring, and the second wiring may be formed by metal on an insulating dielectric plate-like body having multiple wiring layers parallel to a ground plate on which a ground is formed.

For example, a first terminal, a second terminal, a first radiation unit, a second radiation unit, first wiring, and second wiring are formed by a metal pattern on upper and lower surface sides of a plate-like body as a two-layer wiring layer.

In the antenna device according to the present technology described above, the first radiation unit may be helically wound with a constant diameter, and the second radiation unit may also be helically wound with a constant diameter.

That is, the second radiation unit has a relatively large second diameter with a constant helical shape, and the first radiation unit has a relatively small first diameter with a helical shape.

In the antenna device according to the present technology described above, the first radiation unit may be helically wound with a constant diameter, and the open end side of the second radiation unit may be wound so that the diameter is reduced toward the open end.

For example, the diameter of the second radiation unit as a whole may be gradually reduced toward the open end side, or the second radiation unit may have, as the second diameter, a portion having a constant diameter and a portion on the open end side continuous thereto that is gradually reduced in diameter toward the open end side.

In the antenna device according to the present technology described above, the second radiation unit may be helically wound with a constant diameter, and the another end side of the first radiation unit may be wound so that the diameter is reduced toward the another end.

For example, the diameter of the first radiation unit as a whole may be gradually reduced toward the another end side (i.e., side of connection point with first wiring and second wiring), or the first radiation unit may have, as the first diameter, a portion having a constant diameter and a portion on the another end side continuous thereto that is gradually reduced in diameter toward the another end side.

In the antenna device according to the present technology described above, the another end side of the first radiation unit is wound so that the diameter is reduced toward the another end, and the open end side of the second radiation unit is wound so that the diameter is reduced toward the open end.

For example, the diameter of the first radiation unit as a whole may be gradually reduced toward the another end side (i.e., side of connection point with first wiring and second wiring), or the first radiation unit may have, as the first diameter, a portion having a constant diameter and a portion on the another end side continuous thereto that is gradually reduced in diameter toward the another end side.

Moreover, for example, the diameter of the second radiation unit as a whole may be gradually reduced toward the open end side, or the second radiation unit may have, as the second diameter, a portion having a constant diameter and a portion on the open end side continuous thereto that is gradually reduced in diameter toward the open end side.

In the antenna device according to the present technology described above, the first radiation unit and the second radiation unit may be formed by metal on an insulating dielectric plate-like body having multiple wiring layers parallel to a ground plate on which a ground is formed, and the plate-like body may have a shape in which a corner of a rectangular parallelepiped is cut off.

For example, the first radiation unit and the second radiation unit are helically formed by a metal pattern on a plate-like body as a two-layer wiring layer.

In the antenna device according to the present technology described above, the first terminal and the second terminal may be formed on a wiring layer closest to the ground plate among the multiple wiring layers parallel to the ground plate.

For example, the first terminal and the second terminal are formed on the lower surface side (ground plate side) of the plate-like body as the two-layer wiring layer.

In the antenna device according to the present technology described above, the first radiation unit and the second radiation unit may have a helical winding structure using metal wiring on one wiring layer, metal wiring on another wiring layer, and interlayer wiring connecting the one wiring layer and the another wiring layer which are formed on the plate-like body.

For example, the wirings of the wiring layers on the upper surface side and the lower surface side of the plate-like body as a two-layer wiring layer are connected by the interlayer wiring (via or the like) to form a winding structure.

In the antenna device according to the present technology described above, at least one of the first wiring or the second wiring may be formed by using interlayer wiring.

For example, in the wiring structure, a terminal on the lower surface side of the plate-like body as a two-layer wiring layer is connected to the first radiation unit through the interlayer wiring (via or the like).

In the antenna device according to the present technology described above, one of the first wiring and the second wiring as wiring connected to one of the first terminal and the second terminal that is closer to the second radiation unit may be arranged in a space created by a difference in the maximum diameter between the first radiation unit and the second radiation unit.

For example, in a case where the first terminal is closer to the second radiation unit, only the first wiring or both the first wiring and the second wiring are arranged in the space generated by the difference in the maximum diameter.

Alternatively, in a case where the second terminal is closer to the second radiation unit, only the second wiring or both the second wiring and the first wiring are arranged in the space generated by the difference in the maximum diameter.

In the antenna device according to the present technology described above, one of the first wiring and the second wiring may be formed in a helical shape.

That is, the first wiring or the second wiring is formed in a helical shape so as to be continuous with in the first radiation unit.

In the antenna device according to the present technology described above, the longest size of the antenna device may be $\lambda/(2\pi)$ or less ($\lambda$ is carrier wavelength and $\pi$ is pi).

That is, an antenna device called a small electric antenna is formed.

Additionally, in the antenna device according to the present technology described above, one of the first terminal and the second terminal may be a power supply terminal to which a high-frequency signal is input and another may be a short-circuit terminal connected to the ground.

Earphones according to the present technology are earphones including the above-mentioned antenna device and a ground plate on which a ground is formed.

In this case, the antenna device and the ground plate may be arranged so that in a used state, the ground plate is on a human body side when viewed from the antenna device.

This reduces the radiation level toward the human body.

MODE FOR CARRYING OUT THE INVENTION

Hereinafter, embodiments will be described in the following order.

<1. Earphone structure>
<2. Comparative example>
<3. First and second embodiments of antenna device>
<4. Third, fourth, and fifth embodiments of antenna device>
<5. Sixth and seventh embodiments of antenna device>
<6. Arrangement of antenna device in earphone>
<7. Summary and modification>

<1. Earphone structure>

A structure of earphones of an embodiment will be described with reference to FIGS. 1A, 1B, and 1C.

Figure 1A:
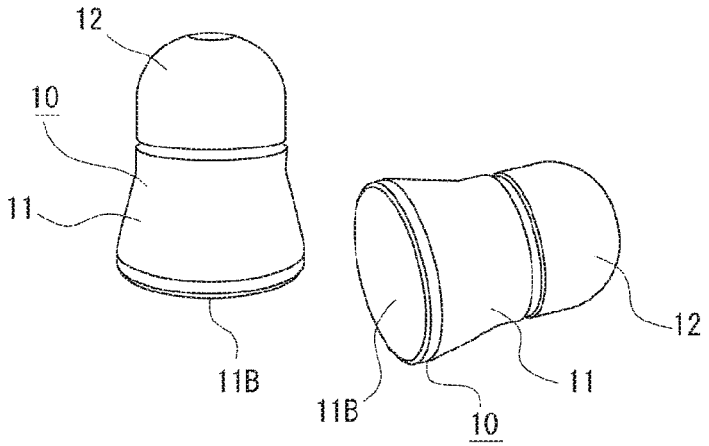
FIGS. 1A, 1B, and 1C are explanatory diagrams of earphones according to an embodiment of the present technology.

FIG. 1A shows an example of the appearance of earphones 10. The earphones 10 have a main body portion 11 and an ear pad 12 attached to the main body portion 11.

The main body portion 11 has a substantially cylindrical shape having a circular cross section, and the ear pad 12 is mounted on a tip end portion thereof.

The earphones 10 are used with the portion of the ear pad 12 inserted into the user's ear canal.

The earphones 10 are so-called wireless earphones, and an antenna unit 1 which is an antenna device for wireless communication is built into the main body portion 11.

Figure 1B:
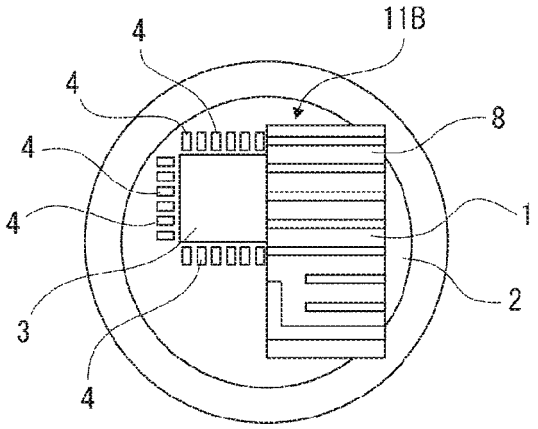
Figure 1C:
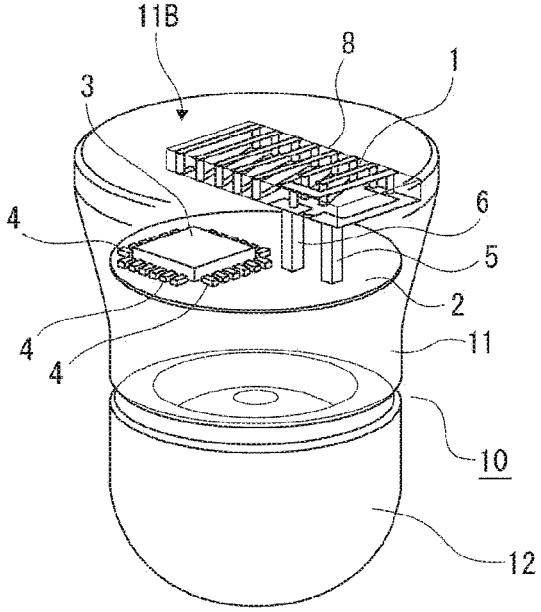

FIGS. 1B and 1C show some of the internally arranged components of the earphones 10. FIG. 1B is a perspective view of the main body portion 11 from a circular surface 11B side (side opposite to ear pad 12), and FIG. 1C is an oblique perpective view with the circular surface 11B side arranged on the upper side.

Note that the circular surface 11B is a surface that is exposed to the outside when the user wears the earphones 10 on the ear canal.

Then, FIGS. 1B and 1C show, as components arranged inside the earphones 10, the antenna unit 1, a substrate 2 on which the ground surface is formed (hereinafter referred to as "ground plate 2"), an integrated circuit (IC) 3, electronic components such as resistors and capacitors included in a peripheral circuit of the IC3 (hereinafter referred to as "peripheral element 4"), a short-circuit unit 5, and a power supply unit 6.

Note that although a driver unit that outputs audio, components that form a sound release path, and the like are also arranged in the main body portion 11, illustration and description thereof will be omitted.

The antenna unit 1 includes an insulating dielectric plate-like body 8 having multiple wiring layers parallel to the ground plate 2. In this plate-like body 8, a radiation unit, necessary terminals, and wiring are formed by a metal pattern. Details will be described later.

In the case of this example, the ground plate 2 has a disk shape so that it can be arranged parallel to the circular surface 11B in the main body portion 11. The ground plate 2 forms the ground surface, in addition to functioning as a circuit board on which the IC3, the peripheral element 4, and other circuits included in a communication circuit or the like are mounted.

The ground plate 2 and the antenna unit 1 (plate-like body 8) are arranged substantially in parallel in the main body portion 11. Then, a high-frequency signal is transmitted by the power supply unit 6 between the antenna unit 1 and the communication circuit formed on the ground plate 2. Additionally, the antenna unit 1 is connected to the ground formed on the ground plate 2 by the short-circuit unit 5.

<2. Comparative Example>

For example, the antenna unit 1 in the earphones 10 as described above is configured as an inverted-F antenna with a helix. An inverted-F antenna is suitable for a small antenna whose impedance drops, because the impedance can be adjusted to some extent only by adjusting the structure.

Incidentally, the inverted-F antenna takes up space for the power supply wiring and the short-circuit wiring. Hence, the antenna unit 1 of the embodiment has a three-dimensional structure to reduce the volume occupied by the power supply/short-circuit wiring and increase the volume of the radiation unit.

Figure 2:
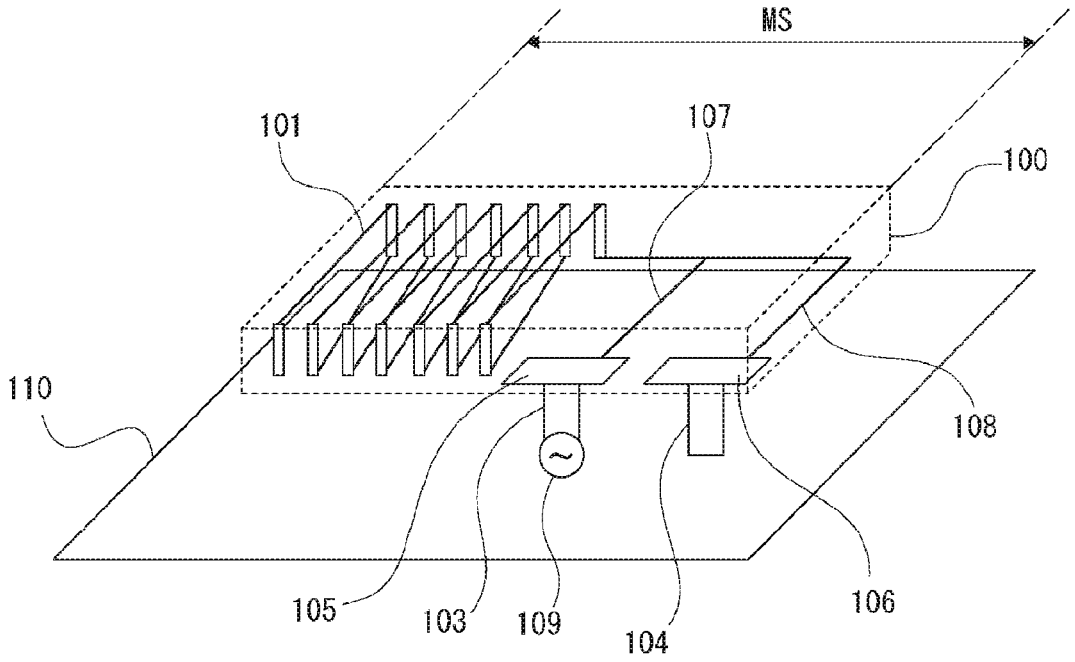
FIG. 2 is an explanatory diagram of a structure of an antenna device as a comparative example.

To facilitate understanding, first, FIG. 2 shows a comparative example to which the structure of the present embodiment is not applied.

FIG. 2 is a configuration example assumed when an inverted-F antenna having a helical structure is considered as a small antenna to be incorporated in earphones or the like as in the present embodiment, for example.

FIG. 2 shows a state in which an antenna unit 100 including a rectangular parallelepiped plate-like body is arranged in parallel with a ground plate 110.

A radiation unit 101, a power supply terminal 105, a short-circuit terminal 106, power supply wiring 107, and short-circuit wiring 108 are formed on the antenna unit 100.

The radiation unit 101 has a helical structure formed in a helical shape.

A high-frequency signal is supplied to the power supply terminal 105 from a high-frequency signal source 109 through a power supply unit 103. The power supply terminal 105 is connected to the radiation unit 101 by the power supply wiring 107.

The short-circuit terminal 106 is connected to the ground formed on the ground plate 110 through a short-circuit unit 104. The short-circuit terminal 106 is connected to the radiation unit 101 by the short-circuit wiring 108.

FIG. 2 shows a state in which only about half of a longitudinal size MS of the antenna unit 100 can be used as the radiation unit 101. That is, about half of the longitudinal size MS is occupied by the power supply wiring 107 and the short-circuit wiring 108.

This is due to various reasons, such as the fact that the arrangement position (separation distance between terminals) of the power supply terminal 105 and the short-circuit terminal 106 is restricted to some extent by the influence of the circuit on the ground plate 110, the connector arrangement, the component size, and the like, or that the terminals need to be formed in a certain size.

If the radiation unit 101 is shortened under these circumstances, the radiation efficiency is lowered and the band is narrowed. In particular, this effect becomes noticeable in a small electric antenna.

Hence, in the present embodiment, even in a case where the longitudinal size MS is equivalent to that of this comparative example, for example, the radiation unit can be lengthened to improve performance.

<3. First and Second Embodiments of Antenna Device>

A structure of an antenna unit 1 as a first embodiment of the antenna device will be described with reference to FIGS. 3A, 3B, and 3C.

Figure 3A:
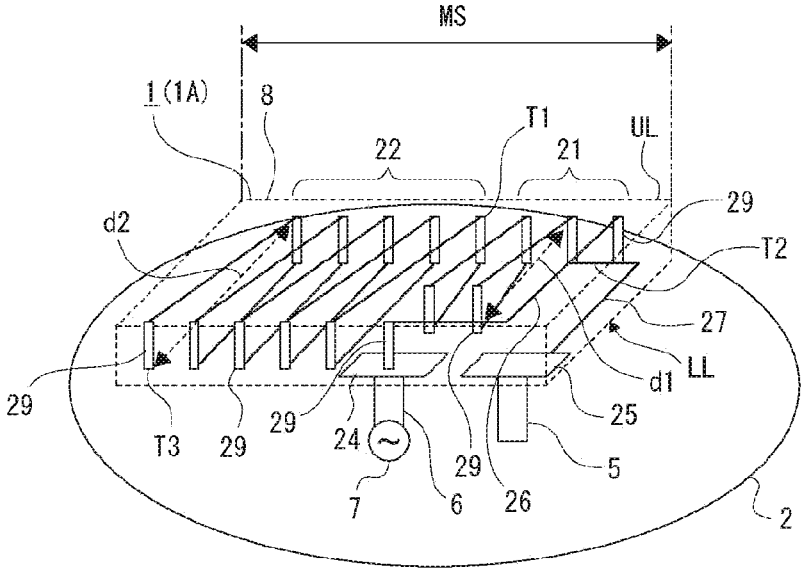
FIGS. 3A, 3B, and 3C is an are explanatory diagrams of a structure of an antenna device of a first embodiment.

FIG. 3A schematically shows the antenna unit 1 and a ground plate 2 arranged in earphones 10 as shown in FIGS. 1B and 1C.

Note that in the following, when describing the antenna units 1 as the first to seventh embodiments separately, the antenna units are distinguished by reference signs "1A", "1B", "1C", "1D", "1E" "1F" and "1G", such as "antenna unit 1A", and when referring to these antenna units collectively, the antenna unit is referred to as "antenna unit 1".

In an antenna unit 1A of the first embodiment, a first radiation unit 21, a second radiation unit 22, a power supply terminal 24, a short-circuit terminal 25, power supply wiring 26, and short-circuit wiring 27 are each formed by a metal pattern on a plate-like body 8 (indicated by broken line) parallel to a ground plate 2.

The plate-like body 8 has a structure having at least two wiring layers. For example, by forming metal patterns on an upper surface and a lower surface, the above-mentioned parts are formed.

Note that for the sake of explanation, the "lower surface" and "upper surface" of the plate-like body 8 are determined by regarding the ground plate 2 side as the lower side. In each figure, the surfaces are shown as a lower surface LL and an upper surface UL.

The upper surface UL side of the plate-like body 8 is the surface on the circular surface 11B side of FIGS. 1A, 1B, and 1C. Each figure is shown according to these upper and lower directions.

At least a wiring layer on the upper surface UL side and a wiring layer on the lower surface LL side are formed on the plate-like body 8. Each wiring layer may be a layer exposed on the upper surface UL or the lower surface LL of the plate-like body 8, or may be a layer not exposed thereon.

Note that in the figure, a part indicated in a vertical columnar shape in the plate-like body 8 is a via 29 (reference sign "29" is assigned to only some of the parts to avoid complication of the figure). The via 29 conducts the wiring layer on the upper surface UL side and the wiring layer on the lower surface LL side.

The maximum length of the plate-like body 8 forming the antenna unit 1A is a longitudinal size MS, and this longitudinal size MS is $\lambda/(2\pi)$ or less when $\lambda$ is the carrier wavelength and $\pi$ is the pi. That is, a small electric antenna that can be adequately incorporated in the above-mentioned earphones 10 is obtained.

Note that while the ground plate 2 is circular, the diameter of the ground plate 2 may also be $\lambda/(2\pi)$ or less.

The first radiation unit 21 and the second radiation unit 22 of the antenna unit 1A have a continuous winding structure. That is, one end of the first radiation unit 21 and one end of the second radiation unit are continuous at a connection end T1.

The second radiation unit 22 has a helical structure helically wound so as to proceed in the longitudinal direction (left side in the drawing) of the plate-like body 8 from the connection end T1, and the other end side is an open end T3.

The winding structure of the second radiation unit 22 is formed by connecting the metal patterns on the wiring layer on the upper surface UL side and the wiring layer on the lower surface LL side of the plate-like body 8 by the vias 29.

The first radiation unit 21 has a helical structure helically wound so as to proceed in the longitudinal direction of the plate-like body 8 between the connection end T1 and the other end side (wiring connection end T2).

The winding structure of the first radiation unit 21, too, is formed by connecting the metal patterns on the wiring layer on the upper surface UL side and the wiring layer on the lower surface LL side of the plate-like body 8 by the vias 29.

Note that the first radiation unit 21 only needs to be wound at least once.

The second radiation unit 22 is formed helically with a constant diameter d2, and the first radiation unit 21 is formed helically with a constant diameter d1.

Then, the diameter d1 of the helical first radiation unit 21 is smaller than the diameter d2 of the similarly helical second radiation unit 22 (d1<d2).

The power supply terminal 24 and the short-circuit terminal 25 are formed on the wiring layer on the lower surface LL side.

The power supply terminal 24 is used as a power supply point, and a high-frequency signal from a high-frequency signal source 7 is supplied by a power supply unit 6. The power supply terminal 24 is connected to the wiring connection end T2 of the first radiation unit 21 by the power supply wiring 26.

Figure 3B:
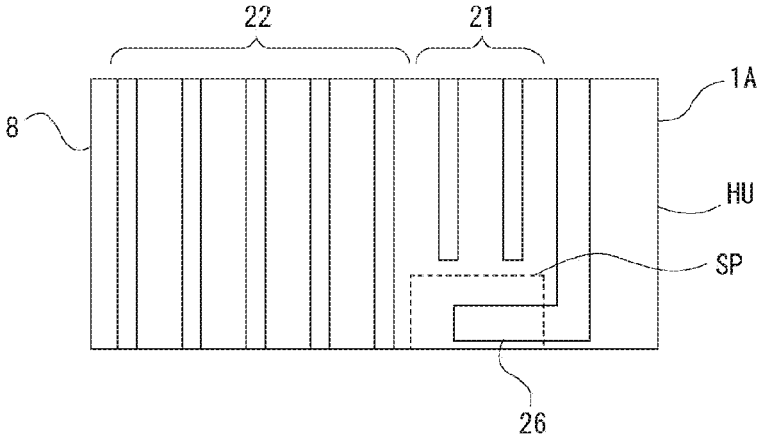
Figure 3C:
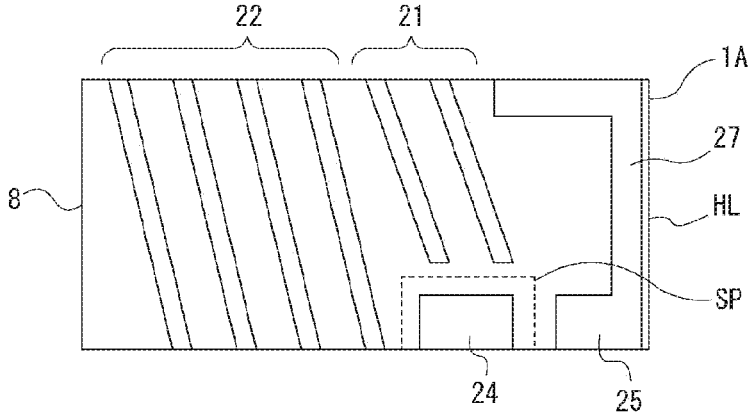

In the example of FIGS. 3A, 3B, and 3C, the power supply wiring 26 is formed so as to reach the wiring connection end T2 from the power supply terminal 24 on the lower surface LL side by the via 29, wiring on the upper surface UL side, and the via 29.

The short-circuit terminal 25 is connected to the ground on the ground plate 2 by a short-circuit unit 5. The short-circuit terminal 25 is connected to the wiring connection end T2 of the first radiation unit 21 by the short-circuit wiring 27.

In the example of FIGS. 3A, 3B, and 3C, the short-circuit wiring 27 is formed so as to reach the wiring connection end T2 as wiring on the lower surface LL side from the short-circuit terminal 25 on the lower surface LL side.

Here, by making a diameter d21 of the first radiation unit 21 smaller than a diameter d22 of the second radiation unit 22 as described above, a space for forming metal patterns is created on the plate-like body 8.

FIG. 3B shows metal patterns formed on a wiring layer HU on the upper surface UL side of the plate-like body 8. Due to the difference between the diameters d21 and d22, a space SP indicated by the broken line is generated in an area forming the entire radiation unit (first radiation unit 21 and second radiation unit 22).

Hence, the power supply wiring 26 is formed by using this space SP.

Additionally, FIG. 3C shows metal patterns formed on a wiring layer HL on the lower surface LL side of the plate-like body 8 (as viewed from above as in FIG. 3B).

Again, due to the difference between the diameters d21 and d22, the space SP indicated by the broken line is generated in an area forming the entire radiation unit. The power supply terminal 24 and the short-circuit terminal 25 are formed by using this space SP.

As described above, the antenna unit 1A of the first embodiment is an inverted-F antenna in which a part excluding the power supply wiring 26 and the short-circuit wiring 27 is divided into the helical first radiation unit 21 and second radiation unit 22.

Then, the diameter d1 of the first radiation unit 21 is smaller than the diameter d2 of the second radiation unit 22, and at least a part of the power supply terminal 24 and the power supply wiring 26 is provided in the space SP generated by this difference in diameter.

That is, the power supply terminal 24 and the power supply wiring 26 do not limit the space for forming the winding of the radiation unit in the longitudinal direction of the plate-like body 8.

Accordingly, since the radiation unit can be formed by making the best use of the volume of the antenna unit 1A, it is possible to improve performance such as the radiation efficiency and the bandwidth of the antenna without changing the antenna size.

Alternatively, according to this configuration, it is possible to maintain performance such as the radiation efficiency and the bandwidth of the antenna even if the antenna size is reduced.

Moreover, there is room for lines and space as a metal pattern as a whole, improving ease of making.

Additionally, in the antenna unit 1A, of the power supply terminal 24 and the short-circuit terminal 25, the power supply terminal 24 is arranged closer to the second radiation unit 22. Since the power supply wiring 26 of the power supply terminal 24 is formed by using the space SP, the components are arranged efficiently to enable extension of the radiation unit in the longitudinal direction.

Additionally, in the antenna unit 1A, the power supply terminal 24 and the power supply wiring 26 on the side close to the second radiation unit 22 are arranged so as to be separated into the wiring layer HU on the upper surface UL side and the wiring layer HL on the lower surface LL side by using the via 29. As a result, the power supply terminal 24 and the power supply wiring 26 can be efficiently formed by using the space SP.

Additionally, in the antenna unit 1A, since the short-circuit terminal 25 and the short-circuit wiring 27 are formed by using the wiring layer HL, the short-circuit wiring 27 and the power supply wiring 26 are separated into the wiring layers HL and HU. As a result, the part occupied by the short-circuit wiring 27 and the power supply wiring 26 in the longitudinal direction can be reduced, so that an area usable by the entire radiation unit can be extended in the longitudinal direction. This also contributes to improving performance as a small antenna.

Figure 4:
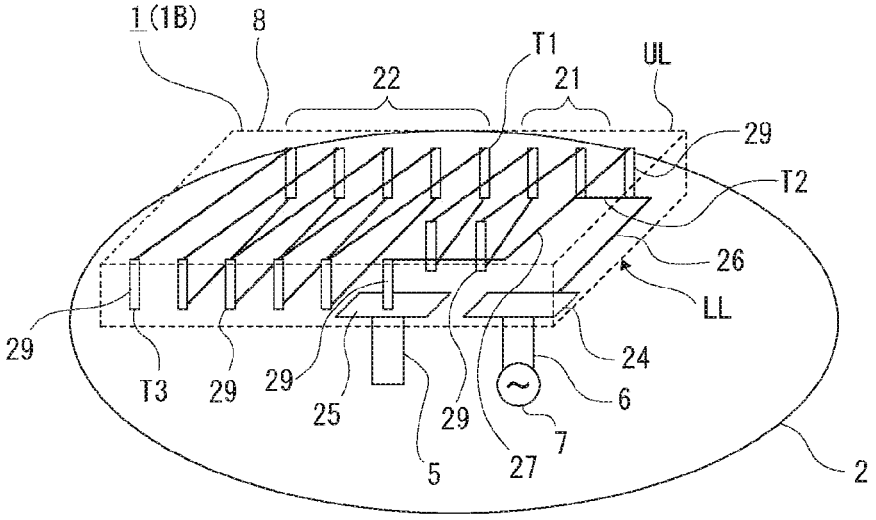
FIG. 4 is an explanatory diagram of a structure of an antenna device of a second embodiment.

FIG. 4 shows an antenna unit 1B of a second embodiment.

The structure of a first radiation unit 21 and a second radiation unit 22 of the antenna unit 1B is similar to that of the antenna unit 1A described above.

The difference is that in the antenna unit 1B, a short-circuit terminal 25 is on the side near the second radiation unit 22, and a power supply terminal 24 is on the side far from the second radiation unit 22.

A high-frequency signal from a high-frequency signal source 7 is supplied to the power supply terminal 24 by a power supply unit 6.

In the example of FIG. 4, power supply wiring 26 is formed so as to reach a wiring connection end T2 as wiring on a lower surface LL side from the power supply terminal 24 on the lower surface LL side.

The short-circuit terminal 25 is connected to the ground on the ground plate 2 by a short-circuit unit 5.

In the example of FIG. 4, the short-circuit wiring 27 is formed so as to reach the wiring connection end T2 from the short-circuit terminal 25 on the lower surface LL side by a via 29, wiring on an upper surface UL side, and the via 29.

That is, in the second embodiment, the short-circuit wiring 27 and the short-circuit terminal 25 are formed by utilizing space created by the difference in diameter between the first radiation unit 21 and the second radiation unit 22.

As a result, similar effect as those of the first embodiment can be obtained.

Then, from the viewpoint of impedance matching, the configuration of the antenna unit 1B may be more suitable than the antenna unit 1A in some cases.

In other words, by selecting the configuration of the antenna unit 1A or 1B depending on the situation, it is possible to implement an antenna device that is advantageous in terms of performance improvement in the case of a same-size device, and performance maintenance in the case of a smaller device.

Note that in the following third to seventh embodiments, the power supply terminal 24 will be arranged closer to the second radiation unit 22 as in the case of the first embodiment. However, in each of these configurations, too, it is conceivable that the short-circuit terminal 25 is arranged closer to the second radiation unit 22 as in the second embodiment.

<4. Third, Fourth, and Fifth Embodiments of Antenna Device>

Antenna units 1C, 1D, and 1E as third, fourth, and fifth embodiments of the antenna device will be described with reference to FIGS. 5, 6, and 7, respectively.

Note that in each of the following embodiments, redundant description will be omitted for the same parts as the antenna unit 1A of the above first embodiment.

Figure 5:
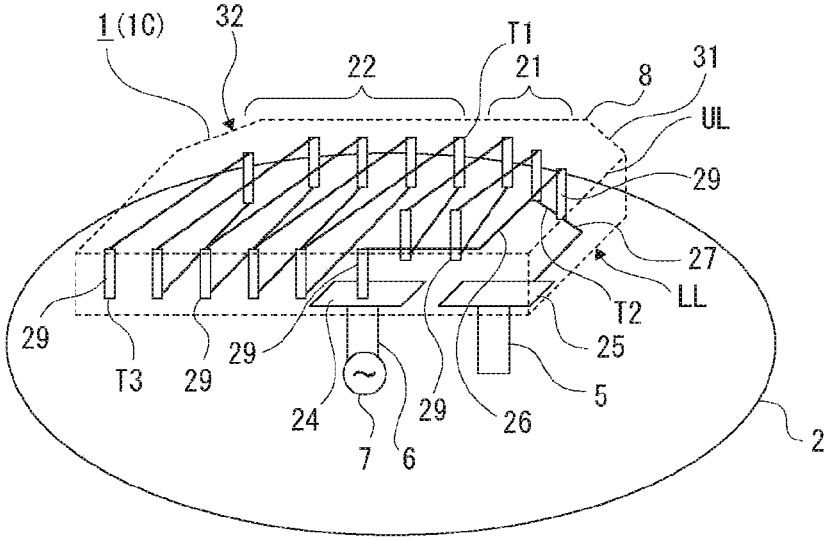
FIG. 5 is an explanatory diagram of a structure of an antenna device of a third embodiment.

FIG. 5 shows the antenna unit 1C of the third embodiment.

In this antenna unit 1C, a first radiation unit 21 is helically wound, but its diameter is not constant. The diameter is gradually reduced from a connection end T1 side toward a wiring connection end T2 side.

Additionally, a second radiation unit 22 is also helically wound, but its diameter is not constant, and the diameter is gradually reduced from the connection end T1 side toward an open end T3 side.

Then, a plate-like body 8 has a shape in which the corners that become excess areas because of such a first radiation unit 21 and second radiation unit 22 are cut off. That is, the corner portion on the second radiation unit 22 side is a notch portion 32, and the corner portion on the first radiation unit 21 side is a notch portion 31.

Figure 6:
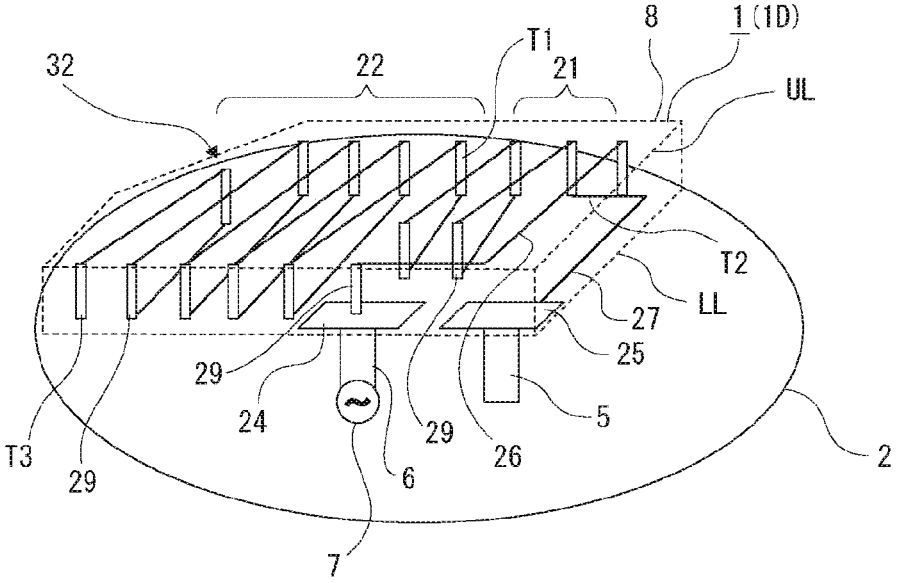
FIG. 6 is an explanatory diagram of a structure of an antenna device of a fourth embodiment.

FIG. 6 shows the antenna unit 1D of the fourth embodiment.

In this antenna unit 1D, a first radiation unit 21 is helically wound with a constant diameter.

On the other hand, a second radiation unit 22 is also helically wound, but its diameter is not constant, and the diameter is gradually reduced from a connection end T1 side toward an open end T3 side.

Then, a plate-like body 8 has a shape in which the corner portion on the second radiation unit 22 side is a notch portion 32.

Figure 7:
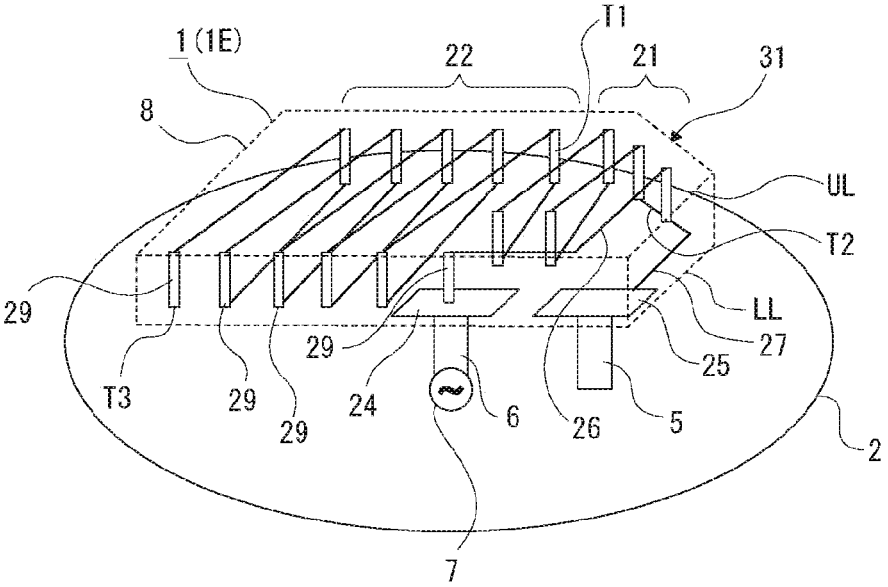
FIG. 7 is an explanatory diagrams of a structure of an antenna device of a fifth embodiment.

FIG. 7 shows the antenna unit 1E of the fifth embodiment.

In this antenna unit 1E, a first radiation unit 21 is helically wound, but its diameter is not constant, and the diameter is gradually reduced from a connection end T1 side toward a wiring connection end T2 side.

Additionally, a second radiation unit 22 is helically wound with a constant diameter.

Then, a plate-like body 8 has a shape in which the corner portion on the first radiation unit 21 side is a notch portion 31.

In these antenna units 1C, 1D, and 1E, the following effects can be obtained in addition to the effects of the antenna unit 1A of the first embodiment.

Figure 8A:
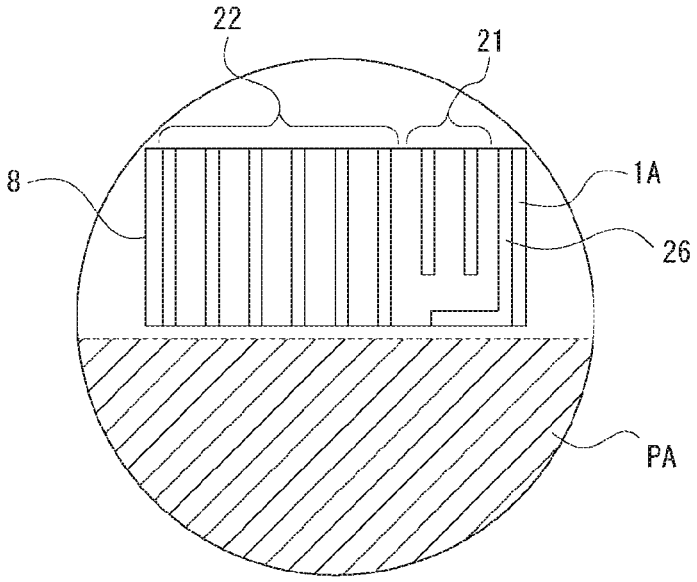
FIGS. 8A and 8B are explanatory diagrams of expansion of a component mountable area according to the third embodiment.
Figure 8B:
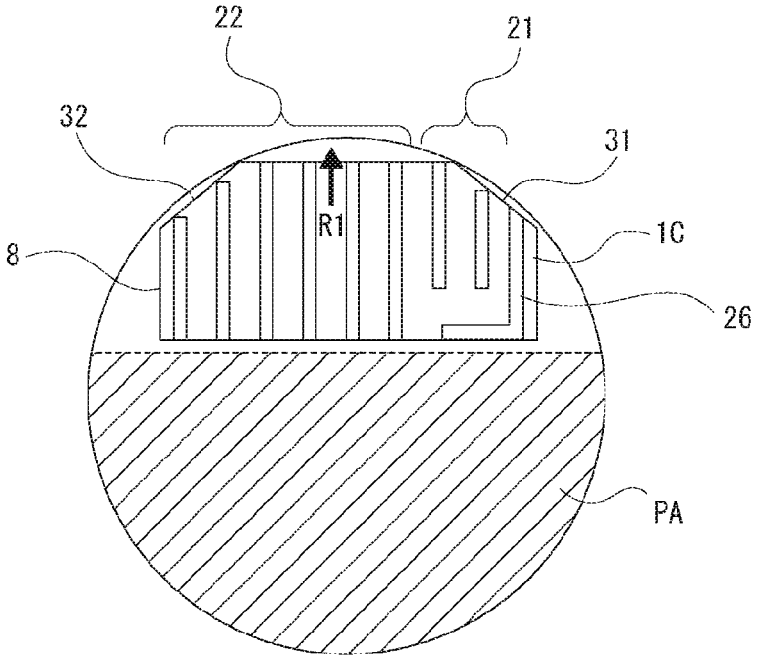

First, in the antenna unit 1C, a component mountable area PA can be expanded as shown in FIGS. 8A and 8B.

FIG. 8A shows a state in which the antenna unit 1A and the ground plate 2 of the first embodiment are viewed from above, and FIG. 8B shows a state in which the antenna unit 1C and the ground plate 2 of the third embodiment are viewed from above.

In the case of the antenna unit 1C, the antenna unit 1C can be arranged close to an arrow R1 direction (circumferential direction of main body portion 11) in a main body portion 11 of earphones 10. For this reason, the component mountable area PA on the ground plate 2 can be wider in the case where the antenna unit 1C is incorporated than the case where the antenna unit 1A is incorporated.

Additionally, since the diameter of the winding is not constant, there is room for various fine adjustments in design.

Figure 9A:
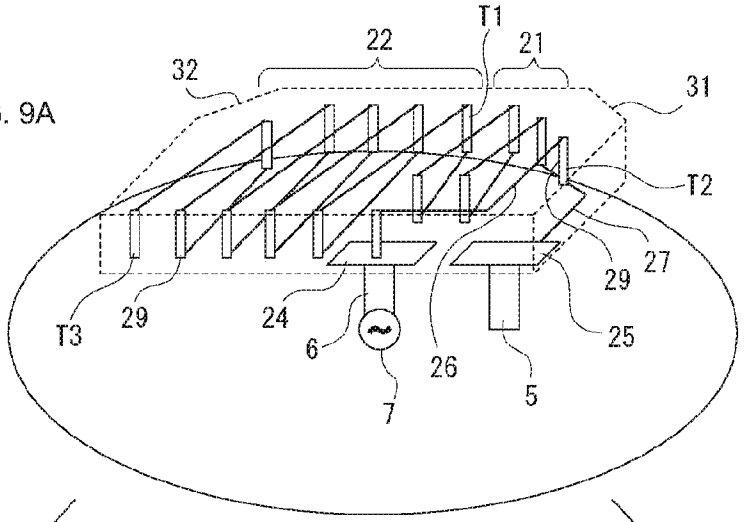
FIGS. 9A, 9B, and 9C are explanatory diagrams of frequency and impedance adjustment according to the third embodiment.
Figure 9C:
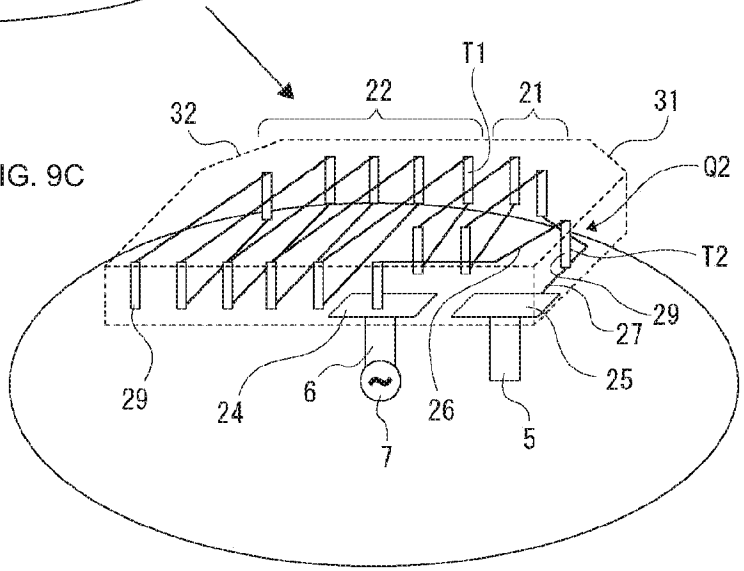
Figure 9B:
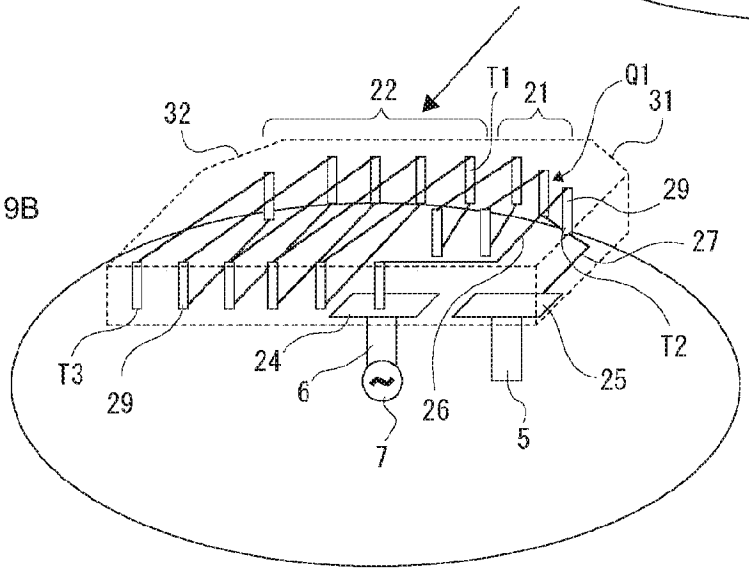

Compared to FIG. 9A, FIG. 9B shows a case where the diameter of an arrow Q1 portion is made even smaller in the portion where the diameter of the first radiation unit 21 is gradually reduced.

By reducing the diameter of the first radiation unit 21, the frequency can be finely adjusted to the high-frequency side. That is, the transmission and reception frequency can be finely adjusted by adjusting the diameter of the first radiation unit 21.

Additionally, compared to FIG. 9A, FIG. 9C shows a case where the position of the via 29 (arrow Q2 portion) of the power supply wiring 26 is changed in the portion where the diameter of the first radiation unit 21 is gradually reduced. As a result, the diameter of the first radiation unit 21 is reduced.

By changing the position of the via 29 of the power supply wiring 26 in this way, the impedance can be finely adjusted.

FIGS. 10A, 10B, 10C, and 10D show the positional relationship between the electronic circuit components and the antenna units 1A and 1C.

Figure 10A:
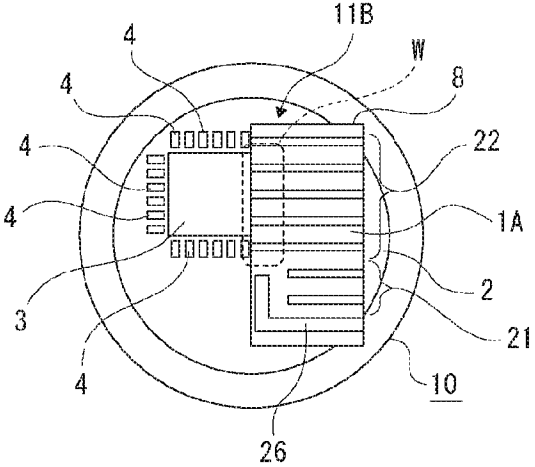
FIGS. 10A, 10B, 10C and 10D are explanatory diagrams of an arrangement relationship with components according to the third embodiment.
Figure 10B:
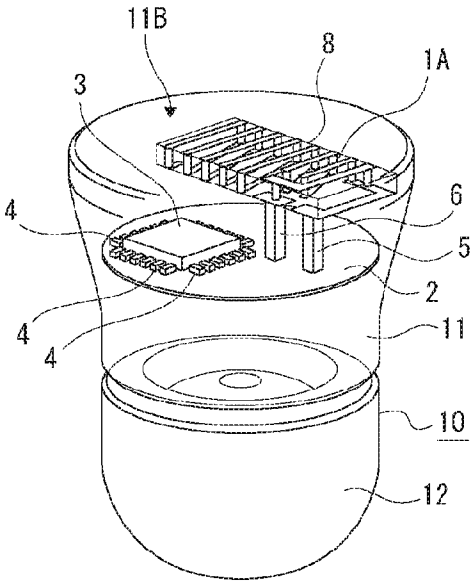

FIGS. 10A and 10B show the case where the antenna unit 1A is incorporated in the earphones 10 as in FIGS. 1B and 1C, and FIGS. 10C and 10D show the case where the antenna unit 1C is incorporated.

As described above, the antenna unit 1C can be arranged closer to the peripheral surface of the main body portion 11 than the case of the antenna unit 1A.

For example, suppose that, in a case of incorporating the antenna unit 1A under the circumstances of the size of the antenna unit 1, the size and number of electronic components, and arrangement, there is a part where electronic components are arranged immediately below the antenna in an overlapping manner as in range W of FIG. 10A. In such a case, the antenna characteristics may be affected, and in that case, it is necessary to change the arrangement.

Figure 10C:
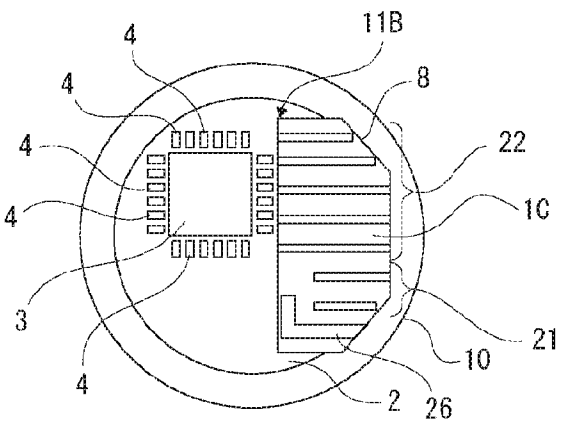
Figure 10D:
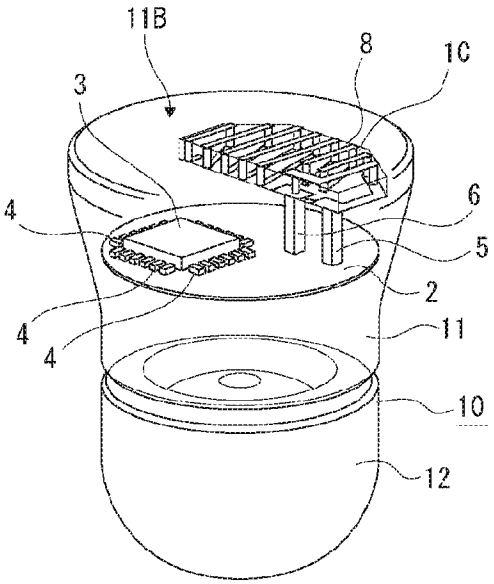

On the other hand, in the case of the antenna unit 1C, as shown in FIG. 10C, there is no part where the antenna unit 1C overlaps the electronic components.

While this is one example, specifically, in the case of the antenna unit 1C, it is easy to avoid a positional relationship in which the electronic components are arranged below the antenna, and designing becomes easy. Alternatively, freedom in design is increased.

FIGS. 11A, 11B, 11C, and 11 D show a case where a touch sensor 15 is provided on a circular surface 11B side of earphones 10. Considering the antenna performance, it is preferable that the touch sensor 15 is arranged so as not to overlap the antenna unit 1 when viewed from the circular surface 11B side.

Figure 11C:
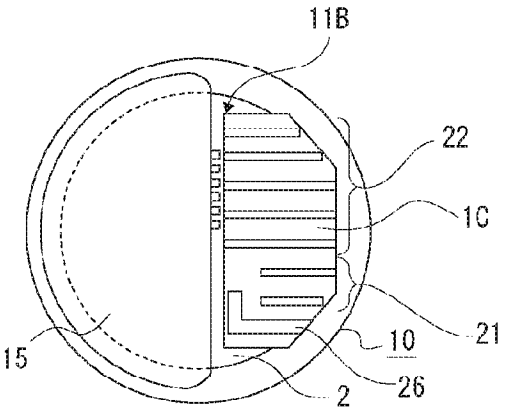
FIGS. 11A, 11B, 11C and 11D are explanatory diagrams of expansion of a touch sensor area according to the third embodiment.
Figure 11D:
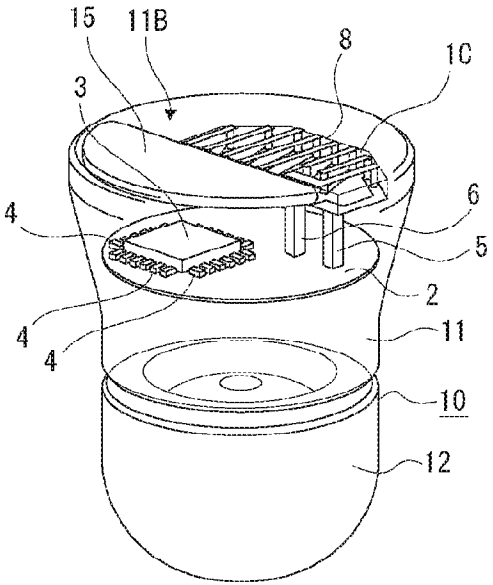
Figure 11A:
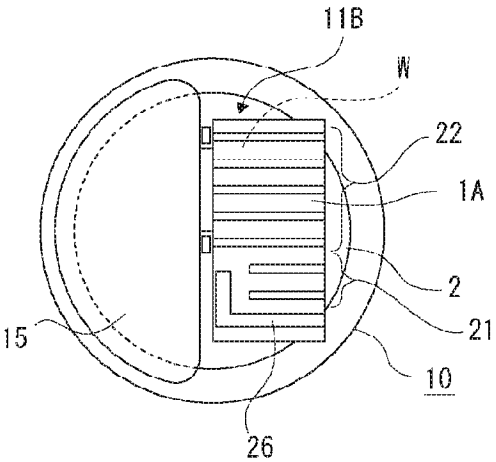
Figure 11B:
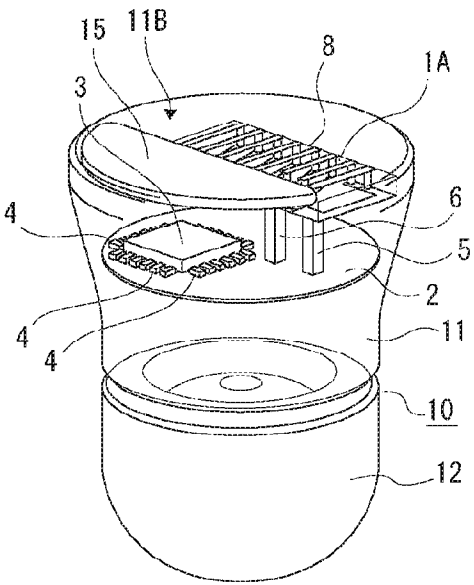

Accordingly, when comparing the case of arranging the antenna unit 1A as in FIGS. 11A and 11B and the case of arranging the antenna unit 1C as in FIGS. 11C and 11D, the area of the touch sensor 15 can be made wider by arranging the antenna unit 1C close to the circumference portion.

Hence, by using the antenna unit 1C, the area of the touch sensor 15 can be made wider, which is also advantageous for improving the sensitivity of the touch sensor.

While expansion of the component mountable area PA has been described in the case of the antenna unit 1C with FIGS. 8A and 8B above, the component mountable area PA can also be expanded with the antenna units 1D and 1E.

Figure 12A:
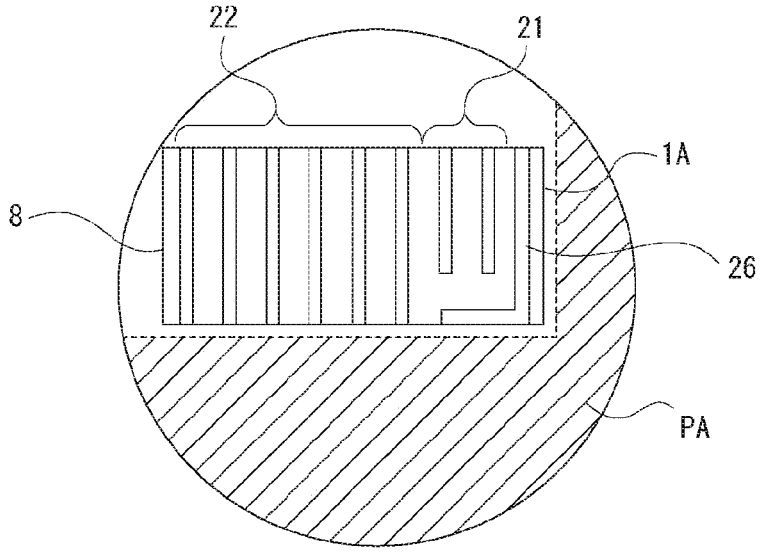
FIGS. 12A and 12B are explanatory diagrams of expansion of a component mountable area according to the fourth embodiment.
Figure 12B:
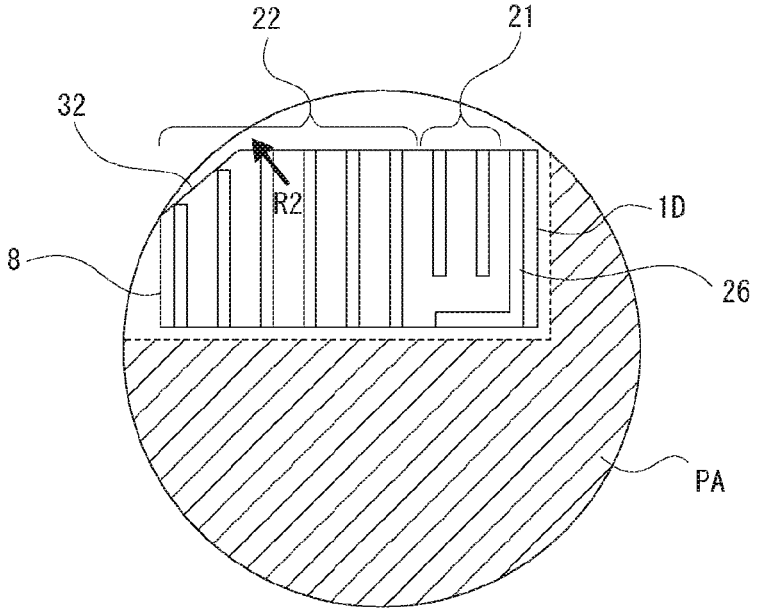

FIG. 12A shows a state in which the antenna unit 1A and the ground plate 2 are viewed from above, and FIG. 12B shows a state in which the antenna unit 1D and a ground plate 2 are viewed from above.

In the case of the antenna unit 1D, the antenna unit 1D can be arranged close to an arrow R2 direction (circumferential direction of main body portion 11) in a main body portion 11 of earphones 10. For this reason, the component mountable area PA on the ground plate 2 can be wider in the case where the antenna unit 1D is incorporated than the case where the antenna unit 1A is incorporated.

Figure 13A:
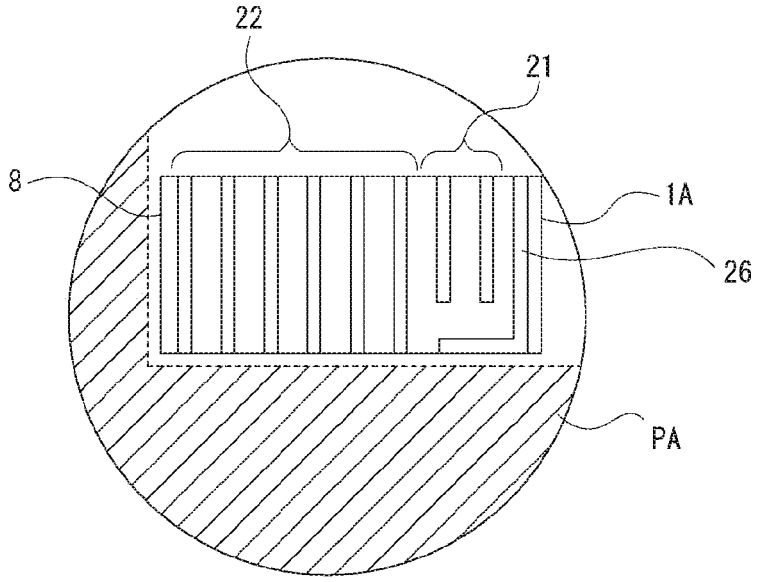
FIGS. 13A and 13B are explanatory diagrams of expansion of a component mountable area according to the fifth embodiment.
Figure 13B:
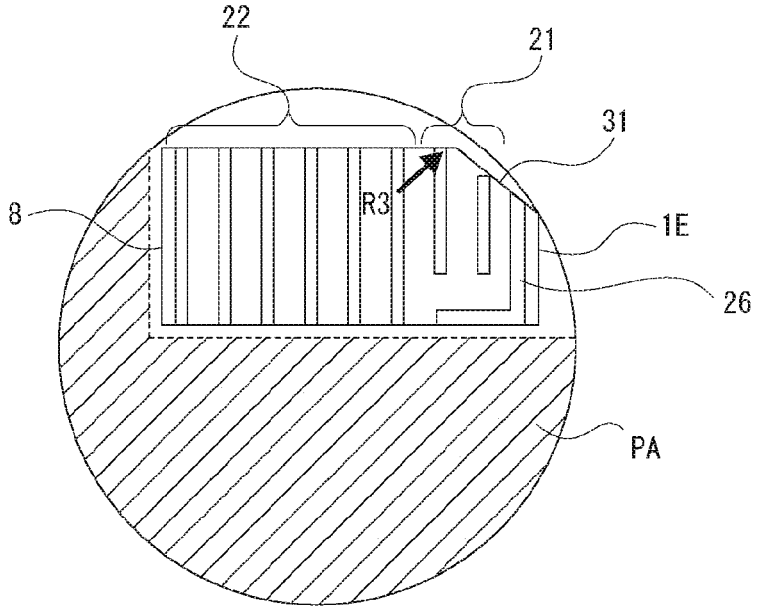

Additionally, FIG. 13A shows a state in which the antenna unit 1A and the ground plate 2 are viewed from above, and FIG. 13B shows a state in which the antenna unit 1E and a ground plate 2 are viewed from above.

In the case of the antenna unit 1E, the antenna unit 1E can be arranged closer to an arrow R3 direction (circumferential direction of main body portion 11) in a main body portion 11 of earphones 10. For this reason, the component mountable area PA on the ground plate 2 can be wider in the case where the antenna unit 1E is incorporated than the case where the antenna unit 1A is incorporated.

Note that while one or both of the first radiation unit 21 and the second radiation unit 22 are gradually reduced in diameter from the connection point T1 in the antenna units 1C, 1D, and 1E, the diameter does not have to be differed for all of the winding portions. For example, in a case where there are many windings, the diameter may be gradually reduced while providing a portion having the same diameter, or the diameter may be differed for at least one winding.

For example, it is conceivable that the second radiation unit 22 has, as a diameter d2, a portion having a constant diameter and a portion on the open end T3 side continuous thereto that is gradually reduced in diameter toward the open end T3. It is also conceivable that only one winding on the open end T3 side has a small diameter.

Additionally, it is also conceivable that the first radiation unit 21 has, as a diameter d1, a portion having a constant diameter and a portion on the wiring connection end T2 side continuous thereto that is gradually reduced in diameter toward the wiring connection end T2. It is also conceivable that only one winding on the wiring connection end T2 side has a small diameter.

<5. Sixth and Seventh Embodiments of Antenna Device>

Figure 14:
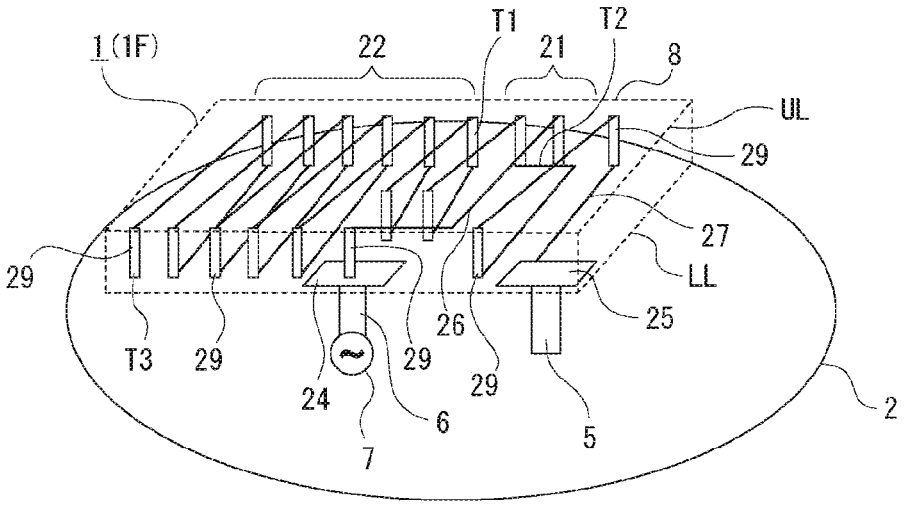
FIG. 14 is an explanatory diagram of a structure of an antenna device of a sixth embodiment.

FIG. 14 shows an antenna unit 1F of a sixth embodiment.

In this antenna unit 1F, short-circuit wiring 27 connected to a wiring connection end T2 of a first radiation unit 21 is also helically wound.

With this configuration, an advantage of widening the range of impedance adjustment can be obtained. Additionally, as a result, the antenna unit 1F may be more suitable than the configuration of the antenna unit 1A, for example, in some cases.

Figure 15:
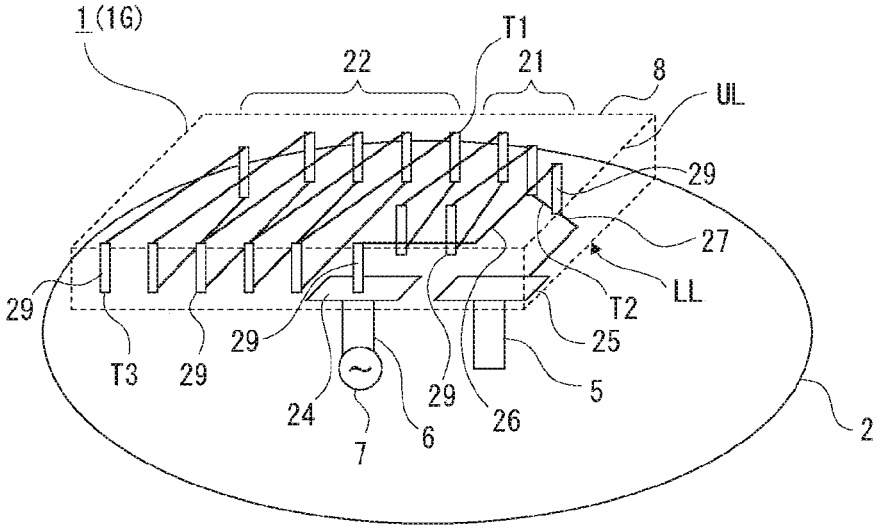
FIG. 15 is an explanatory diagram of a structure of an antenna device of a seventh embodiment.

FIG. 15 shows an antenna unit 1G of a seventh embodiment.

Similarly to the antenna unit 1C of the third embodiment, in this antenna unit 1G, the diameter of a helical winding of a first radiation unit 21 is gradually reduced from a connection end T1 side toward a wiring connection end T2 side. Additionally, the diameter of a helical winding of a second radiation unit 22 is also gradually reduced from the connection end T1 side toward an open end T3 side.

On the other hand, a plate-like body 8 has a rectangular parallelepiped shape with no corners cut off.

Thus, it is also assumed, for example, that the diameter of the helical winding is not constant while the shape of the plate-like body 8 remains a rectangular parallelepiped. In a case where a rectangular parallelepiped can be arranged with no particular problem, it is assumed that such a structure is adopted for the purpose of frequency adjustment and impedance adjustment.

<6. Arrangement of Antenna Device in Earphone>

The arrangement and radiation directivity of the antenna unit 1 in the earphones 10 will be described.

Figure 16A:
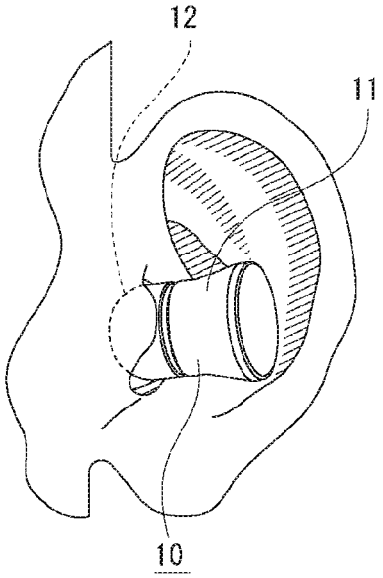
FIGS. 16A, 16B, and 16C are explanatory diagrams of an antenna arrangement in earphones of the embodiment.
Figure 16B:
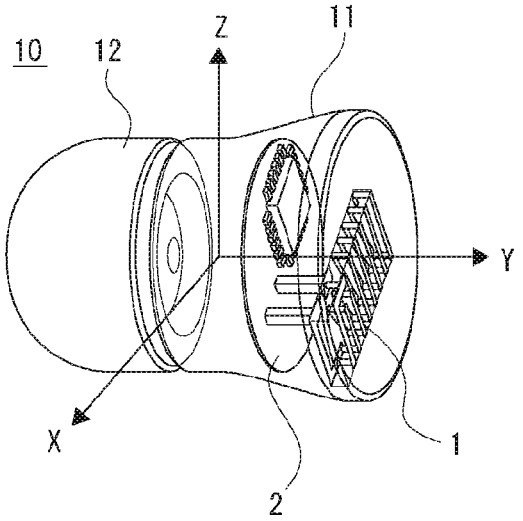

FIG. 16A shows a state in which the earphone 10 is worn on the user's ear canal. FIG. 16B shows the X, Y, and Z directions in this worn state.

When the earphones 10 are worn, the direction of the human body is the ground plate 2 side, which suppresses radiation toward the human body.

Figure 16C:
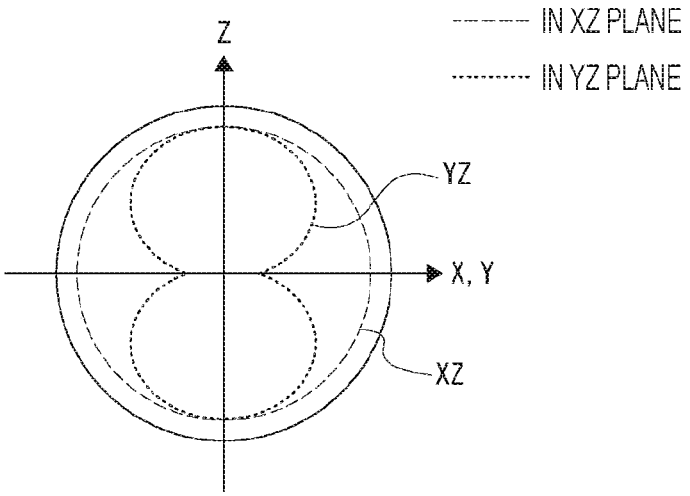

FIG. 16C shows the radiation directivity of the antenna unit 1 as seen in the XZ plane and the YZ plane.

The antenna unit 1 is designed so that radiation toward the human body becomes small as shown by this radiation directivity. Then, it is possible to reduce a characteristic change at the time of wearing and a characteristic change when the wearing direction is rotated about the Y axis.

<7. Summary and Modification>

According to the above embodiments, the following effects can be obtained.

The antenna unit 1 of the embodiment has the power supply terminal 24 (one example of first terminal) into which a high-frequency signal is input, and the short-circuit terminal 25 (one example of second terminal) connected to the ground. The first radiation unit 21 is formed in a helical shape having a maximum diameter of d1. The second radiation unit 22 is formed in a helical shape in which one end (connection end T1) is continuous with one end (connection end T1) of the first radiation unit 21, the maximum diameter d2 is larger than the diameter d1, and the other end is the open end T3. The antenna unit 1 further includes the power supply wiring 26 (one example of first wiring) connecting the other end (wiring connection end T2) of the first radiation unit 21 and the power supply terminal 24, and the short-circuit wiring 27 (one example of second wiring) connecting the other end (wiring connection end T2) of the first radiation unit 21 and the short-circuit terminal 25.

In the case of this configuration, either the power supply wiring 26 from the power supply terminal 24 or the short-circuit wiring 27 from the short-circuit terminal 25 can be wired in a space created by the difference in diameter between the first radiation unit 21 and the second radiation unit 22.

Then, in other words, the radiation unit (first radiation unit 21 and second radiation unit 22) can be formed with no regard to the arrangement of the power supply wiring 26 or the short-circuit wiring 27.

That is, since the radiation unit (21,22) can be formed by making the best use of the volume of the antenna unit 1, performance such as the radiation efficiency and the bandwidth of the antenna can be improved without changing the antenna size.

Alternatively, in a case where the antenna size is reduced, performance such as the radiation efficiency and the bandwidth of the antenna can be maintained by adopting the configuration of the embodiment.

Additionally, there is room for wiring and space as a whole, and the freedom in design and ease of manufacturing are improved.

Note that while the power supply terminal 24 is the first terminal and the short-circuit terminal 25 is the second terminal in the above description, the power supply terminal 24 may be considered as the second terminal and the short-circuit terminal 25 may be considered as the first terminal. In that case, the power supply wiring 26 is the second wiring and the short-circuit wiring 27 is the first wiring.

In the antenna unit 1 of the embodiment, the power supply terminal 24, the short-circuit terminal 25, the power supply wiring 26, the short-circuit wiring 27, the first radiation unit 21, and the second radiation unit 22 are formed by metal on the insulating dielectric plate-like body 8 having multiple wiring layers parallel to the ground plate 2.

For example, by using upper and lower surfaces of a rectangular parallelepiped or a partially cut rectangular parallelepiped plate-like body, the helical first radiation unit 21 and second radiation unit 22 can be easily created by a metal pattern.

Specifically, in this case, the first radiation unit 21 and the second radiation unit 22 include two layers of wiring and the vias 29 connecting the layers, and are helically wound along the longitudinal direction of the antenna unit 1.

Note that while a helical structure can be formed by including at least two wiring layers, the wiring layers may adopt a multi-layer structure including three layers or four layers, for example.

In the antenna units 1A, 1B, and 1F of the first, second, and sixth embodiments, the first radiation unit 21 and the second radiation unit 22 are each helically wound with a constant diameter.

That is, the second radiation unit 22 has a relatively large diameter d2 with a constant helical shape, and the first radiation unit 21 has a relatively small diameter d1 with a helical shape.

In this case, a space is formed in the wiring layer due to the difference between the diameters d1 and d2, and this configuration is an example in which the power supply wiring 26 and the short-circuit wiring 27 can be arranged effectively.

The antenna unit 1D of the fourth embodiment is an example in which the first radiation unit 21 is helically wound with a constant diameter, and the open end T3 side of the second radiation unit 22 is wound so that the diameter is reduced toward the open end T3.

This configuration is also an example in which a space is formed due to the difference in the maximum diameter between the first radiation unit 21 and the second radiation unit 22, and the power supply wiring 26 and the short-circuit wiring 27 can be arranged effectively.

Additionally, in the case of adopting this configuration, the antenna unit 1 can have a shape in which the corner of the plate-like body 8 on the second radiation unit 22 side is cut off (shape having notch portion 32). This increases the freedom in arranging the antenna unit 1.

Then, in a case of arranging the antenna unit 1 in the main body portion 11 of the earphones 10 having a circular cross section, the antenna unit 1 can be brought close to the circumferential portion as described with reference to FIGS. 12A and 12B, and a wide component mountable area PA on the ground plate 2 can be secured.

The antenna unit 1E of the fifth embodiment is an example in which the second radiation unit 22 is helically wound with a constant diameter, and the other end side (wiring connection end T2 side) of the first radiation unit 21 is wound so that the diameter is reduced toward the other end.

This configuration is also an example in which a space is formed due to the difference in the maximum diameter between the first radiation unit 21 and the second radiation unit 22, and the power supply wiring 26 and the short-circuit wiring 27 can be arranged effectively.

Additionally, by adjusting the diameter of the first radiation unit 21, the frequency can be finely adjusted to the high-frequency side and the impedance can be finely adjusted.

Additionally, in the case of adopting this configuration, too, the antenna unit 1 can have a shape in which the corner of the plate-like body 8 on the other end side (wiring connection end T2 side) of the first radiation unit 21 is cut off (shape having notch portion 31). This increases the freedom in arranging the antenna unit 1.

Then, in a case of arranging the antenna unit 1 in the main body portion 11 of the earphones 10 having a circular cross section, the antenna unit 1 can be brought close to the circumferential portion as described with reference to FIGS. 13A and 13B, and a wide component mountable area PA on the ground plate 2 can be secured.

The antenna unit 1C of the third embodiment is an example in which the other end side (wiring connection end T2 side) of the first radiation unit 21 is wound so that the diameter is reduced toward the other end, and the open end T3 side of the second radiation unit 22 is wound so that the diameter is reduced toward the open end T3.

This configuration is also an example in which a space is formed due to the difference in the maximum diameter between the first radiation unit 21 and the second radiation unit 22, and the power supply wiring 26 and the short-circuit wiring 27 can be arranged effectively.

Additionally, in the case of adopting this configuration, the antenna unit 1 can have a shape in which the corner of the plate-like body 8 on the open end side of the second radiation unit 22 and the corner of the plate-like body 8 on the other end side (side of connection point of power supply wiring 26 and short-circuit wiring 27) of the first radiation unit 21 are cut off (shape having notch portions 32 and 31). This further increases the freedom in arranging the antenna unit 1.

Then, in a case of arranging the antenna unit 1 in the main body portion 11 of the earphones 10 having a circular cross section, the antenna unit 1 can be brought close to the circumferential portion as described with reference to FIGS. 8A and 8B, and a wider component mountable area PA on the ground plate 2 can be secured.

In particular, since the antenna unit 1 has the shape notched on both sides and can be arranged close to the circumferential portion, the fact that no component is placed below the antenna unit 1 as described with reference to FIG. 10B is also an advantage. As a result, it is possible to avoid overlap between the antenna unit 1 and the components which will affect the characteristics, and a change in arrangement of the components due to the affected characteristics.

Additionally, as described with reference to FIG. 11 B, in a case of providing the touch sensor 15, a sufficient area can be secured for the touch sensor 15. Accordingly, it is also advantageous for implementing a touch sensor 15 having good sensitivity.

Note that although these effects can also be obtained with the fourth and fifth embodiments (notch on one side), the effects become remarkable when the shape is notched on both sides.

In the antenna units 1C, 1D, and 1E of the third, fourth, and fifth embodiments, the first radiation unit 21 and the second radiation unit 22 are formed by metal on the insulating dielectric plate-like body 8 having multiple wiring layers parallel to the ground plate 2, and the plate-like body 8 has a shape in which the corner of the rectangular parallelepiped is cut off (shape having one or both of notch portions 32 and 31).

If the diameter of the helix is not constant, the plate-like body 8 can have a shape with the corner cut off. As a result, the freedom in arranging the antenna unit 1 is improved as described above, and it is possible to arrange the antenna unit 1 close to the peripheral surface of the cylindrical main body portion 11 in the earphones 10.

In the antenna unit 1 of the embodiment, the power supply terminal 24 and the short-circuit terminal 25 are formed on the wiring layer on the lower surface LL side of the plate-like body 8 which is closest to the ground plate among the multiple wiring layers parallel to the ground plate 2.

This facilitates connection with the ground plate.

In the antenna unit 1 of the embodiment, the first radiation unit 21 and the second radiation unit 22 have a helical winding structure using metal wiring on one wiring layer, metal wiring on another wiring layer, and interlayer wiring (via 29) connecting the one wiring layer and the other wiring layer which are formed on the plate-like body 8.

As a result, the first radiation unit 21 and the second radiation unit 22 are formed by the metal pattern on the plate-like body 8, and a space can be created in the wiring layer due to the difference in diameter between the first radiation unit 21 and the second radiation unit 22.

In the antenna unit 1 of the embodiment, at least one of the power supply wiring 26 or the short-circuit wiring 27 is formed by using the interlayer wiring (via 29). For example, in the antenna unit 1A, the power supply wiring 26 is formed by using the via 29, and in the antenna unit 1B, the short-circuit wiring 27 is formed by using the via 29.

As a result, the first radiation unit 21 having a helical structure in the plate-like body and the power supply terminal (or short-circuit terminal 25) can be appropriately connected by the power supply wiring 26 (or short-circuit wiring 27).

In particular, the power supply wiring 26 and the short-circuit wiring 27 can be distributed to different wiring layers, and the space created by the difference in diameter can be effectively used for each wiring.

In the antenna unit 1 of the embodiment, the wiring (power supply wiring 26 or short-circuit wiring 27) connected to one of the power supply terminal 24 and the short-circuit terminal 25 closer to the second radiation unit 22 is arranged in the space created by the difference in the maximum diameter between the first radiation unit 21 and the second radiation unit 22.

For example, in a case where the power supply terminal 24 is closer to the second radiation unit 22, only the power supply wiring 26 or both the power supply terminal 24 and the power supply wiring 26 are arranged in the space SP generated by the difference in the maximum diameter.

Alternatively, in a case where the short-circuit terminal 25 is closer to the second radiation unit 22, only the short-circuit wiring 27 or both the short-circuit terminal 25 and the short-circuit wiring 27 are arranged in the space SP generated by the difference in the maximum diameter.

For example, as shown in the comparative example, there may be cases where space cannot be effectively utilized due to wiring from one of the power supply terminal 24 and the short-circuit terminal 25 that is closer to the radiation unit. In the embodiment, at least wiring from one of the power supply terminal 24 and the short-circuit terminal 25 that is closer to the second radiation unit 22 is arranged in the space SP generated due to the first radiation unit 21. Hence, wiring is appropriate in terms of space efficiency.

In the antenna unit 1F of the sixth embodiment, an example in which the short-circuit wiring 27 is formed in a helical shape is given. It is conceivable to form the short-circuit wiring 27 in a helical shape as in this example or to form the power supply wiring 26 in a helical shape.

As a result, the range of impedance adjustment can be widened and antenna performance can be improved in some cases.

The longest size of the antenna unit 1 of the embodiment is assumed to be $\lambda/(2\pi)$ or less.

That is, an antenna device called a small electric antenna is formed. It is possible to improve the antenna performance in a small electric antenna.

The earphones 10 of the embodiment include the antenna unit 1 and the ground plate 2.

Then, the antenna unit and the ground plate are arranged so that in the used state, the ground plate 2 is on the human body side when viewed from the antenna unit 1. This reduces radiation toward the human body.

Note that the effect described in the present specification is merely an example and is not limited, and other effects can be obtained.

Note that the present technology can also be configured in the following manner.

(1)

An antenna device including:

a first terminal;

a second terminal;

a first radiation unit that is formed in a helical shape whose maximum diameter is a first diameter;

a second radiation unit that is formed in a helical shape having one end continuous with one end of the first radiation unit and whose maximum diameter is a second diameter larger than the first diameter, and having another end which is an open end;

first wiring that connects another end of the first radiation unit and the first terminal; and second wiring that connects the another end of the first radiation unit and the second terminal.

(2)

The antenna device according to (1) above, in which the first terminal, the second terminal, the first radiation unit, the second radiation unit, the first wiring, and the second wiring are formed by metal on an insulating dielectric plate-like body having multiple wiring layers parallel to a ground plate on which a ground is formed.

(3)

The antenna device according to (1) or (2) above, in which the first radiation unit is helically wound with a constant diameter, and the second radiation unit is also helically wound with a constant diameter.

(4)

The antenna device according to (1) or (2) above, in which the first radiation unit is helically wound with a constant diameter, and the open end side of the second radiation unit is wound so that the diameter is reduced toward the open end.

(5)

The antenna device according to (1) or (2) above, in which the second radiation unit is helically wound with a constant diameter, and the another end side of the first radiation unit is wound so that the diameter is reduced toward the another end.

(6)

The antenna device according to (1) or (2) above, in which the another end side of the first radiation unit is wound so that the diameter is reduced toward the another end, and the open end side of the second radiation unit is wound so that the diameter is reduced toward the open end.

(7)

The antenna device according to any one of (1) to (6) above, in which the first radiation unit and the second radiation unit are formed by metal on an insulating dielectric plate-like body having multiple wiring layers parallel to a ground plate on which a ground is formed, and the plate-like body has a shape in which a corner of a rectangular parallelepiped is cut off.

(8)

The antenna device according to (2) above, in which the first terminal and the second terminal are formed on a wiring layer closest to the ground plate among the multiple wiring layers parallel to the ground plate.

(9)

The antenna device according to any one of (2), (7), and (8) above, in which the first radiation unit and the second radiation unit have a helical winding structure using metal wiring on one wiring layer, metal wiring on another wiring layer, and interlayer wiring connecting the one wiring layer and the another wiring layer which are formed on the plate-like body.

(10)

The antenna device according to any one of (2), (7), (8), and (9) above, in which at least one of the first wiring or the second wiring is formed by using interlayer wiring.

(11)

The antenna device according to any one of (1) to (10) above, in which one of the first wiring and the second wiring as wiring connected to one of the first terminal and the second terminal that is closer to the second radiation unit is arranged in a space created by a difference in the maximum diameter between the first radiation unit and the second radiation unit.

(12)

The antenna device according to any one of (1) to (11) above, in which one of the first wiring and the second wiring is formed in a helical shape.

(13)

The antenna device according to any one of (1) to (12) above, in which a longest size of the antenna device is $\lambda/(2\pi)$ or less, provided that A is the carrier wavelength and $\pi$ is the pi.

(14)

The antenna device according to any one of (1) to (13) above, in which one of the first terminal and the second terminal is a power supply terminal to which a high-frequency signal is input and another is a short-circuit terminal connected to a ground.

(15)

Earphones including an antenna device having a first terminal, a second terminal, a first radiation unit that is formed in a helical shape whose maximum diameter is a first diameter, a second radiation unit that is formed in a helical shape having one end continuous with one end of the first radiation unit and whose maximum diameter is a second diameter larger than the first diameter, and having another end which is an open end, first wiring that connects another end of the first radiation unit and the first terminal, and second wiring that connects the another end of the first radiation unit and the second terminal, and a ground plate on which a ground is formed.

(16)

The earphones according to (14) above, in which the antenna device and the ground plate are arranged so that in a used state, the ground plate is on a human body side when viewed from the antenna device.

REFERENCE SIGNS LIST

1, 1A, 1B, 1C, 1D, 1E, 1F, 1G Antenna unit

2 Ground plate

3 IC

4 Peripheral element

5 Short-circuit unit

6 Power supply unit
7 High-frequency signal source
8 Plate-like body
10 Earphones
11 Main body portion
12 Ear pad
15 Touch sensor
21 First radiation unit
22 Second radiation unit
24 Power supply terminal
25 Short-circuit terminal
26 Power supply wiring
27 Short-circuit wiring
29 Via
31, 32 Notch portion
T1 Connection end
T2 Wiring connection end
T3 Open end

The invention claimed is:

1. An antenna device comprising:
a first terminal;
a second terminal;
a first radiation unit that is formed in a helical shape whose maximum diameter is a first diameter;
a second radiation unit that is formed in a helical shape having one end continuous with one end of the first radiation unit and whose maximum diameter is a second diameter larger than the first diameter, and having another end which is an open end;
a first wiring that connects another end of the first radiation unit and the first terminal; and
a second wiring that connects the another end of the first radiation unit and the second terminal.

2. The antenna device according to claim 1, wherein
the first terminal, the second terminal, the first radiation unit, the second radiation unit, the first wiring, and the second wiring are formed by metal on an insulating dielectric plate-like body having a plurality of wiring layers parallel to a ground plate on which a ground is formed.

3. The antenna device according to claim 1, wherein
the first radiation unit is helically wound with a constant diameter, and
the second radiation unit is also helically wound with a constant diameter.

4. The antenna device according to claim 1, wherein
the first radiation unit is helically wound with a constant diameter, and
the open end of the second radiation unit is wound so that the diameter is reduced toward the open end.

5. The antenna device according to claim 1, wherein
the second radiation unit is helically wound with a constant diameter, and
the another end of the first radiation unit is wound so that the diameter is reduced toward the another end.

6. The antenna device according to claim 1, wherein
the another end of the first radiation unit is wound so that the diameter is reduced toward the another end, and
the open end of the second radiation unit is wound so that the diameter is reduced toward the open end.

7. The antenna device according to claim 1, wherein
the first radiation unit and the second radiation unit are formed by metal on an insulating dielectric plate-like body having a plurality of wiring layers parallel to a ground plate on which a ground is formed, and
the plate-like body has a shape in which a corner of a rectangular parallelepiped is cut off.

8. The antenna device according to claim 2, wherein
the first terminal and the second terminal are formed on a wiring layer closest to the ground plate among the plurality of wiring layers parallel to the ground plate.

9. The antenna device according to claim 2, wherein
the first radiation unit and the second radiation unit have a helical winding structure using metal wiring on one wiring layer, metal wiring on another wiring layer, and interlayer wiring connecting the one wiring layer and the another wiring layer which are formed on the plate-like body.

10. The antenna device according to claim 2, wherein
at least one of the first wiring or the second wiring is formed by using interlayer wiring.

11. The antenna device according to claim 1, wherein
one of the first wiring and the second wiring as wiring connected to one of the first terminal and the second terminal that is closer to the second radiation unit is arranged in a space created by a difference in the maximum diameter between the first radiation unit and the second radiation unit.

12. The antenna device according to claim 1, wherein
one of the first wiring and the second wiring is formed in a helical shape.

13. The antenna device according to claim 1, wherein
a longest size of the antenna device is $\lambda/(2\pi)$ or less, provided that $\lambda$ is carrier wavelength and $\pi$ is pi.

14. The antenna device according to claim 1, wherein
one of the first terminal and the second terminal is a power supply terminal to which a high-frequency signal is input and another is a short-circuit terminal connected to a ground.

15. Earphones comprising:
an antenna device including a first terminal, a second terminal, a first radiation unit that is formed in a helical shape whose maximum diameter is a first diameter, a second radiation unit that is formed in a helical shape having one end continuous with one end of the first radiation unit and whose maximum diameter is a second diameter larger than the first diameter, and having another end which is an open end, a first wiring that connects another end of the first radiation unit and the first terminal, and a second wiring that connects the another end of the first radiation unit and the second terminal; and
a ground plate on which a ground is formed.

16. The earphones according to claim 15, wherein
the antenna device and the ground plate are arranged so that in a used state, the ground plate is on a human body side when viewed from the antenna device.

* * * * *